United States Patent [19]

Sakai et al.

[11] 4,454,225

[45] * Jun. 12, 1984

[54] COLOR PHOTOGRAPHIC LIGHT-SENSITIVE MATERIAL

[75] Inventors: Nobuo Sakai; Yoshio Seoka; Kozo Aoki, all of Kanagawa, Japan

[73] Assignee: Fuji Photo Film Co., Ltd., Kanagawa, Japan

[ * ] Notice: The portion of the term of this patent subsequent to Jun. 8, 1999 has been disclaimed.

[21] Appl. No.: 384,119

[22] Filed: Jun. 1, 1982

[30] Foreign Application Priority Data

Jun. 1, 1981 [JP] Japan ..... 56-84163

[51] Int. Cl.[3] ..... G03C 1/46

[52] U.S. Cl. ..... 430/505; 430/552; 430/553; 430/554; 430/555; 430/558

[58] Field of Search ..... 430/505, 551, 552, 553, 430/554, 555, 558

[56] References Cited

U.S. PATENT DOCUMENTS

| | | | |
|---|---|---|---|
| 3,127,269 | 3/1964 | Greenhalgh et al. | 430/386 |
| 3,703,375 | 11/1972 | Groet et al. | 430/505 |
| 4,334,011 | 6/1982 | Aoki et al. | 430/553 |

*Primary Examiner*—J. Travis Brown

*Attorney, Agent, or Firm*—Sughrue, Mion, Zinn, Macpeak, and Seas

[57] ABSTRACT

A color photographic light-sensitive material comprising a support having thereon a green-sensitive silver halide emulsion layer containing a magenta dye forming coupler represented by the following general formula (I)

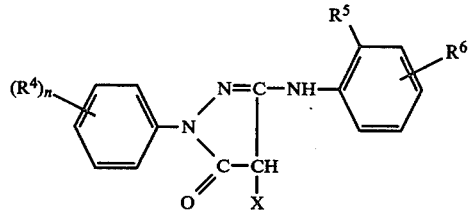

(I)

wherein $R^4$ represents a halogen atom, a substituted or unsubstituted alkyl group or a substituted or unsubstituted alkoxy group; $R^5$ represents a hydrogen atom, a halogen atom, a nitro group, a substituted or unsubstituted alkyl group, a substituted or unsubstituted alkoxy group or a substituted or unsubstituted acylamino group; $R^6$ represents a hydrogen atom, a halogen atom or a mono-valent organic residue; X represents a hydrogen atom or a group capable of being released upon coupling and exhibiting a two-equivalent property; and n represents an integer from 1 to 5 and when n represents 2 or more, $R^4$ may be the same or different, and a red-sensitive silver halide emulsion layer containing a cyan dye forming coupler represented by the following general formula (II)

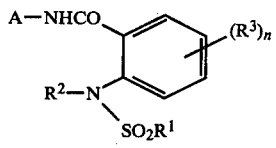

(II)

wherein A represents a cyan coupler residue, but the -NHCO group does not bond to A in the active position of A; $R^1$ represents a substituted or unsubstituted alkyl group or a substituted or unsubstituted aryl group, $R^2$ represents hydrogen or a substituted or unsubstituted alkyl group; each $R^3$ independently represents a hydrogen atom, a halogen atom, an alkyl group or an alkoxy group; and n represents an integer from 1 to 3 and when n represents 2 or more. The color photographic light-sensitive material provides a color image in which the yellow stain at the unexposed area upon irradiation of light is prevented.

19 Claims, No Drawings

COLOR PHOTOGRAPHIC LIGHT-SENSITIVE MATERIAL

FIELD OF THE INVENTION

The present invention relates to a color photographic light-sensitive material containing a coupler, and more particularly to a color photographic light-sensitive material capable of providing a color image in which yellow discoloration at the unexposed areas due to irradiation of light is prevented.

BACKGROUND OF THE INVENTION

By the color development of a color photographic light-sensitive material, after exposure, an oxidized aromatic primary amine developing agent is reacted with a coupler to form a dye, thus, a color image is formed. In this system, a subtractive method is generally used for color reproduction. In accordance with such a system blue, green and red colors are reproduced by forming yellow, magenta and cyan color images which are in complimentary relation thereto, respectively. In general, acylacetamide or dibenzoylmethane type couplers are employed for forming yellow or color images, pyrazolone, cyanoacetyl or indazolone type couplers are used for forming magenta color images, and phenol type couplers, for example, phenols and naphthols, are utilized for forming cyan color images.

To produce color photographs, couplers which form dyes are incorporated into a developer or are present in light-sensitive photographic emulsion layer(s). A variety of 5-pyrazolone type couplers for forming magenta color images are known. Known substituents at the 3-position of the 5-pyrazolone ring include an alkyl group, an aryl group, the alkoxy groups as described in U.S. Pat. No. 2,439,098, the acylamino groups as described in U.S. Pat. Nos. 2,369,489 and 2,600,788, and the ureido groups as described in U.S. Pat. No. 3,558,319 and an anilino group. 3-Anilino-5-pyrazolone type couplers have often been described in the art since U.S. Pat. No. 2,311,081 (U.S. Pat. No. Re. 22,329) was issued and several improvements have been proposed. British Pat. No. 956,261 discloses that azomethine dyes obtained from derivatives in which the ortho position of the anilino group is substituted with an alkoxy group or a halogen atom have advantageous spectral absorption for color photography in that undesired absorption in the red light region is particularly low.

Specific examples of diffusion resistant couplers which belong to this type and are capable of being incorporated into photographic emulsions are described in U.S. Pat. Nos. 3,930,861, 3,907,571, 3,928,044 and 3,935,015, etc.

These couplers have the characteristics that the undesired absorption of magenta azomethine dyes obtained upon color formation using the same in the red light region is low, the cut off the main absorption is good at the longer wavelength side, and magenta color images having a high color density are obtained because the coloration speed is high. Furthermore, their solubility in organic solvents having a high boiling point is improved so that, after dissolving these couplers in organic solvents, the couplers are emulsion dispersed in an aqueous medium in the form of colloidal particles and then added to emulsions. However, these couplers have the disadvantages that the degree of yellow staining at the unexposed portion after color development processing is high and this degree of yellow staining is increased upon irradiation with light. These disadvantages are particularly serious for color light-sensitive material such as color printing papers, etc. which are irradiated with actinic rays for a long period of time.

In order to eliminate these disadvantages, it has been proposed that the structure of the coupler per se is appropriately selected thereby improving the light fastness. On the other hand, many methods for improving the light fastness using various additives have also been proposed. For example, methods in which a compound such as an ultraviolet radiation absorbing agent, a hydroquinone derivative, a phenol derivative, or tocopherol, etc. is employed are known. Further, a compound in which the hydroxy group in the above described hydroquinone derivative, phenol derivative or chroman derivative such as tocopherol is substituted with an alkoxy group, an acyloxy group, etc. is recently proposed for the purpose. However, these methods using such additives have a limit. For example, a relatively large amount of the compound must be added to obtain sufficient light fastness which is frequently accompanied with various disadvantages, for examples, coloration, change in color hue, formation of fog, etc. due to the compound added.

SUMMARY OF THE INVENTION

An object of the present invention is to provide a color photographic light-sensitive material capable of forming a color image in which yellow discoloration at the unexposed areas due to irradiation of light is prevented.

Other objects of the present invention will become more apparent from the detailed description of the invention and the examples hereinbelow.

After various investigation, it has been found that the above described objects of the present invention can be achieved by comprising a support having thereon a green-sensitive silver halide emulsion layer containing a magenta dye forming coupler represented by the following general formula (I)

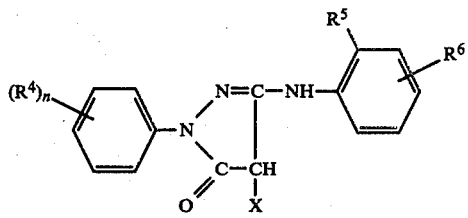

(I)

wherein $R^4$ represents a halogen atom, a substituted or unsubstituted alkyl group or a substituted or unsubstituted alkoxy group; $R^5$ represents a hydrogen atom, a halogen atom, a nitro group, a substituted or unsubstituted alkyl group, a substituted or unsubstituted alkoxy group or a substituted or unsubstituted acylamino group; $R^6$ represents a hydrogen atom, a halogen atom or a mono-valent organic residue; X represents a hydrogen atom or a group capable of being released upon coupling and exhibiting a two-equivalent property; and n represents an integer from 1 to 5 and when n represents 2 or more, $R^4$ may be the same or different, and a red-sensitive silver halide emulsion layer containing a cyan dye forming coupler represented by the following general formula (II)

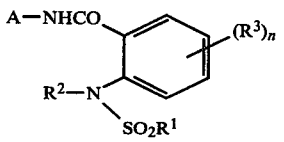

(II)

wherein A represents a cyan coupler residue, but the —NHCO group does not bond to A in the active position of A; $R^1$ represents a substituted or unsubstituted alkyl group or a substituted or unsubstituted aryl group, $R^2$ represents hydrogen or a substituted or unsubstituted alkyl group; $R^3$ represents a hydrogen atom, a halogen atom, an alkyl group or an alkoxy group; and n represents an integer from 1 to 3 and when n represents 2 or more, $R^3$ may be the same or different.

DETAILED DESCRIPTION OF THE INVENTION

In the above described general formula (I), $R^4$ represents a hydrogen atom, a halogen atom (for example, a fluorine atom, a chlorine atom, a bromine atom, etc.), an alkyl group having 1 to 22 carbon atoms which may be substituted or an alkoxy group having 1 to 22, preferably 1 to 15, carbon atoms which may be substituted. n represents an integer from 1 to 5 and when n represents 2 or more, $R^4$ may be the same or different. Preferably, $R^4$ represents a halogen atom or an alkoxy group having 1 to 15 carbon atoms. $R^5$ represents a hydrogen atom, a halogen atom, a nitro group, an alkyl group having 1 to 22 carbon atoms which may be substituted, an alkoxy group having 1 to 22 carbon atoms which may be substituted or an acylamino group which may be substituted. $R^6$ represents a hydrogen atom, a halogen atom or a mono-valent organic residue, for example, a nitro group, a carbamoyl group having up to 22 carbon atoms which may be substituted, a sulfamoyl group having up to 22 carbon atoms which may be substituted, an alkyl succinimido group having up to 22 carbon atoms which may be substituted, an alkoxycarboamido group having up to 22 carbon atoms which may be substituted, an alkoxycarboalkylamino group having up to 22 carbon atoms which may be substituted, an alkylaminocarboalkylamino group having up to 22 carbon atoms which may be substituted, an aralkoxycarboalkylamino group having up to 22 carbon atoms which may be substituted, an arylaminocarboalkylamino group having up to 22 carbon atoms which may be substituted or an aralkyaminocarboalkylamino group, etc. X represents a hydrogen atom or a group capable of being released upon coupling and exhibiting a two-equivalent property, for example, an alkylthio group which may be substituted, an arylthio group which may be substituted, an aralkylthio group which may be substituted, a group of the formula

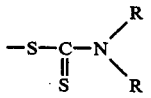

wherein R represents a hydrogen atom, an alkyl group or an aryl group, a pyrazolyl group which may be substituted, an imidazolyl group which may be substituted, a triazolyl group which may be substituted, or a group of the formula

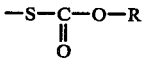

wherein R represents a hydrogen atom, an alkyl group or an aryl group, etc.

In the general formula (I), $R^4$ is preferably a halogen atom, $R^5$ is preferably a halogen atom and X is preferably an alkylthio group, an arylthio group or an aralkylthio group.

In the above described general formula (II), A represents a cyan coupler residue, but the —NHCO group does not bond to A in the active coupling position of A, $R^1$ represents a substituted or unsubstituted alkyl group having from 1 to 22 carbon atoms or a substituted or unsubstituted aryl group having 6 to 22 carbon atoms, with an alkyl group being preferred, $R^2$ represents hydrogen or a substituted or unsubstituted alkyl group having from 1 to 22 carbon atoms, with a hydrogen atom and an unsubstituted alkyl group being preferred, $R^3$ represents a hydrogen atom, a halogen atom (for example, a fluorine atom, a chlorine atom, a bromine atom, etc.), an alkyl group having from 1 to 22 carbon atoms (for example, a methyl group, a butyl group, a pentadecyl group, etc.) or an alkoxy group having from 1 to 22 carbon atoms (for example, a methoxy group, an ethoxy group, a 2-ethyl hexyloxy group, etc.), n represents an integer from 1 to 3 and when n represents 2 or more, $R^3$ may be the same or different.

The substituents of the alkyl groups and aryl groups represented by $R^1$ and $R^2$ are selected from a halogen atom, a nitro group, a cyano group, an aryl group (for example, a phenyl group, a naphthyl group, etc.), an alkoxy group (for example, a methoxy group, an ethoxy group, etc.), an aryloxy group (for example, a phenyloxy group, a naphthyloxy group, etc.), a carboxy group, an alkylcarbonyl group (for example, an acetyl group, a tetradecanoyl group, etc.), an arylcarbonyl group (for example, a benzoyl group, etc.), an alkoxycarbonyl group (for example, a methoxycarbonyl group, a benzyloxycarbonyl group, etc.), an aryloxycarbonyl group (for example, a phenyloxycarbonyl group, a p-tolyloxycarbonyl group, etc.), an acyloxy group (for example, an acetyloxy group, a tetradecanoyloxy group, etc.), a sulfamoyl group (for example, an N-ethylsulfamoyl group, an N-octadecylsulfamoyl group, etc.), a carbamoyl group (for example, an N-ethylcarbamoyl group, an N-methyl-N-dodecylcarbamoyl group, etc.), an acylamino group (for example, an acetylamino group, a benzamido group, etc.), a diacylamino group (for example, a succinimido group, a hydantoinyl group, etc.), a ureido group (for example, a methyl ureido group, a phenylureido group, etc.), an arylamino group (for example, a (4-methoxyphenyl-)amino group, etc.), an N-alkylanilino group (for example, an N-methylanilino group, an N-butylanilino group, etc.), an N-acylanilino group (for example, an N-acetylanilino group, an N-trichloroacetylanilino group, etc.), a hydroxy group, and a mercapto group, etc. When an alkyl group is substituted with a fluorine atom, the group may be the so-called polyfluoroalkyl group.

Examples of $R^1$ include a methyl group, a butyl group, a methoxyethyl group, a dodecyl group, a phenoxypropyl group, a p-chlorophenoxybutyl group, a p-tolyl group, a p-dodecylphenyl group, a p-chlorophenyl group, and a naphthyl group. Examples of $R^2$ include a methyl group, a butyl group, an octyl group, a hexadecyl group, a 2-chloroethyl group, and a 2-methoxyethyl group.

Among the cyan coupler residues represented by A, preferred residues are phenol cyan coupler residues represented by the following general formula (III).

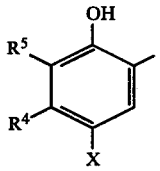

(III)

In the general formula (III), $R^4$ represents an alkyl group which may be substituted, an alkylacylamino group which may be substituted, or an arylacylamino group which may be substituted, wherein the substituents are the same as those of the alkyl group represented by $R^1$ as described above. Examples of the alkyl group include a methyl group, an ethyl group, a butyl group, a pentadecyl group, a phenylthiomethyl group and a chloromethyl group. Examples of the alkylacylamino group include a butyrylamino group, a pivaloylamino group and 2-(2',4'-di-tert-amylphenoxy)butanamido group. An example of the arylacylamino group includes a benzoylamino group.

$R^5$ represents a hydrogen atom or a halogen atom (for example, a fluorine atom, a chlorine atom, a bromine atom, etc.). X represents a hydrogen atom or a group capable of being released by an oxidation coupling reaction with a developing agent (for example, a halogen atom, an alkoxy group, an aryloxy group, an acyloxy group, an imido group, a sulfonamido group, a thiocyano group, etc.).

A particularly preferred $R^4$, is an alkylacylamino group which may be substituted.

Hydrogen is particularly preferred as $R^5$.

The amount to be added of each of the magenta couplers represented by the general formula (I) and the cyan coupler represented by the general formula (II) is generally from $2\times10^{-3}$ mol to $5\times10^{-1}$ mol, preferably from $1\times10^{-2}$ mol to $5\times10^{-1}$ mol per mol of silver in the silver halide emulsion layer. It is preferred that the amount to be added of the cyan coupler is 1/10 of that of the magenta coupler or more.

Specific examples of the compounds represented by the general formula (I) are set forth below, but the present invention is not to be construed as being limited thereto.

M-1: 1-(2,6-Dichloro-4-methoxyphenyl)-3-{3[α-(2,4-di-tert-amylphenoxy)butylamido]anilino}-4-phenylthio-5-oxo-2-pyrazoline M-2: 1-(2,4,6-Trichlorophenyl)-3-(2-chloro-5-tetradecanamido)anilino-5-oxo-2-pyrazolin-4-yldiethylphosphate M-3: N,N-Diphenyl[1-(2,4,6-trichlorophenyl)-3-(2-methoxy-5-tetradecyloxycarbonyl)anilino-5-oxo-2-pyrazolin-4-yl]oxamate M-4: S-[1-(2,6-Dichloro-4-methoxycarbonylphenyl)-3-(2-chloro-5-tetradecyloxycarbonylanilino)-5-oxo-2-pyrazolin-4yl]n-butyldithiocarbamate M-5: 1-(2,6-Dichloro-4-tetradecyloxycarbonylphenyl)-3-(2-chloro-5-methoxycarbonylanilino)-4-succinimido-5-oxo-2-pyrazoline M-6: 1-(2,4,6-Trichlorophenyl)-3-(2,4-dichloroanilino)-4-(4-tetradecanamidophenylsulfonamido)-5-oxo-2-pyrazoline M-7: 1-(4-Acetamidophenyl)-3-(2-methoxy-5-tetradecyloxycarbonylanilino)-4-(5,5-dimethyl-2,4-dioxo-3-hydantoinyl)-5-oxo-2-pyrazoline M-8: 1-(2,4,6-Trichlorophenyl)-3-(2-chloro-5-tetradecanamidoanilino)-4-benzylthio-5-oxo-2-pyrazoline M-9: 1-(2,4,6-Trichlorophenyl)-3-(2,4-dichloroanilino)-4-(3-dodecylcarbamoylphenylthio)-5-oxo-2-pyrazoline M-10: 1-(2,4,6-Trichlorophenyl)-3-(2-chloro-5-tetradecanamidoanilino)-4-octadecylsulfonyl-5-oxo-2-pyrazoline M-11: 1-(2,4,6-Trichlorophenyl)-3-(2-chloro-5-tetradecanamidoanilino)-5-oxo-2-pyrazoline M-12: 1-(2,4,6-Trichlorophenyl)-3-(2-chloro-5-tetradecanamidoanilino)-4-(2-butoxy-5-1',1',3',3'-tetramethylbutylphenylthio)-5-oxo-2-pyrazoline M-13: 1-(2,4,6-Trichlorophenyl)-3-(2-chloro-5-tetradecanamidoanilino)-4-(phenoxypropylthio)-5-oxo-2-pyrazoline M-14: 1-(2,4,6-Trichlorophenyl)-3-(2-chloro-5-tetradecanamidoanilino)-4-butylthio-5-oxo-2-pyrazoline Specific examples of the compounds represented by the general formula (II) are set forth below, but the present invention is not to be construed as being limited thereto.

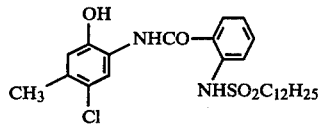

C-(1)

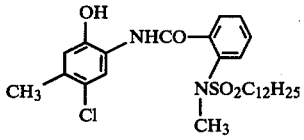

C-(2)

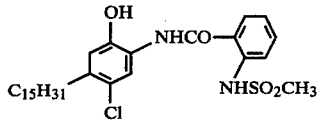

C-(3)

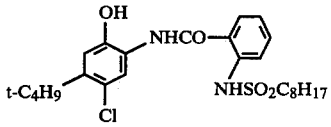

C-(4)

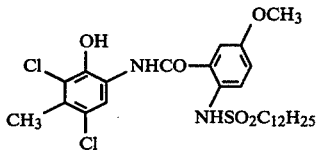

C-(5)

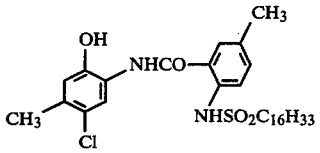

C-(6)

-continued

C-(7)

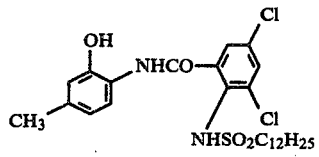

C-(8)

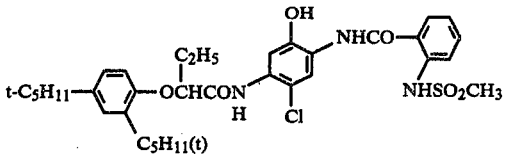

C-(9)

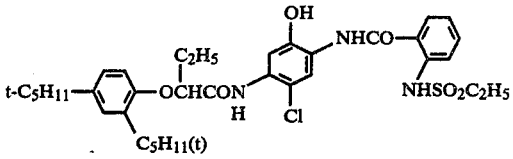

C-(10)

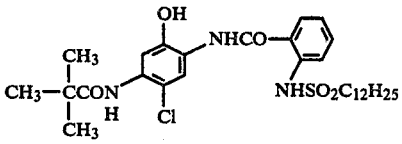

C-(11)

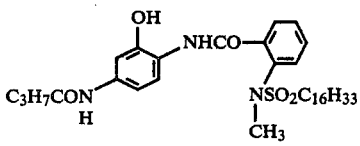

C-(12)

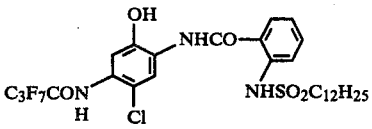

C-(13)

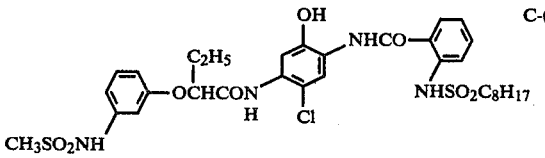

C-(14)

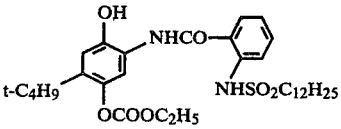

C-(15)

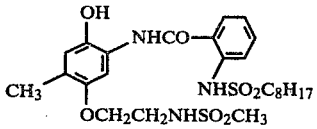

C-(16)

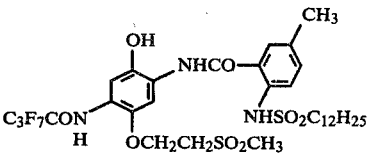

-continued

C-(17)

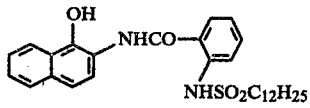

C-(18)

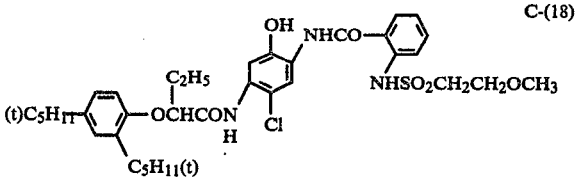

C-(19)

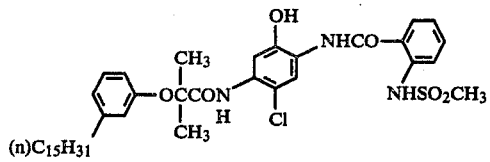

C-(20)

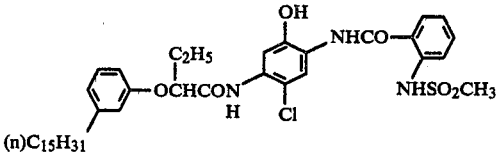

The cyan coupler represented by the general formula (II) can be synthesized by processes as described below.

An anthranilic acid ester is condensed with a corresponding sulfonic acid chloride, using pyridine or triethylamine as a deacidifying agent, to produce an o-sulfonylaminobenzoic acid ester. If necessary, it is possible to carry out N-alkylation thereof, using an alkylhalide and a strong base such as sodium hydride. The resulting ester is hydrolyzed in the presence of alkali hydroxide to produce a benzoic acid derivative, which is then processed with thionyl chloride or phosphorus ocychloride to produce an acid chloride. The resulting acid chloride and the corresponding 2-aminophenol derivative are refluxed in acetonitrile, by which an o-sulfoamidobenzoylaminophenol can be synthesized.

In the case of synthesizing a 2,5-diacylaminophenol derivative, a 5-nitro derivative is first synthesized. After the nitro group is reduced to form an amino group, the product is reacted with another acid chloride to produce a coupler.

Examples of synthesis of typical couplers according to the present invention are specifically described below.

Synthesis of 4-chloro-2-(dodecanesulfonamidobenzoylamino)-5-methylphenol: Coupler C-(1)

1. Synthesis of 2-dodecanesulfonamidobenzoyl chloride 16.5 g of ethyl anthranilate and 22 g of dodecanesulfonyl chloride were dissolved in 100 ml of tetrahydrofuran. To the mixture, 17 ml of triethylamine was added dropwise at 50° C. After stirring for 8 hours, ethyl acetate was added, and the mixture was washed with diluted hydrochloric acid and then with water. An oily product obtained by distilling off the solvent under a reduced pressure was dissolved in 100 ml of ethanol, and a solution obtained by dissolving 12 g of sodium hydroxide in 100 ml of water was added thereto. The mixture was stirred at 50° C. for 4 hours. Crystals deposited by acidifying with hydrochloric acid after cooling were collected by filtration and washed with water. After drying, 26 g of crystals were obtained. 100 ml of benzene was added to the crystals and 14 ml of thionyl chloride was added dropwise thereto. After heated for 3 hours with refluxing, the solvent and excess thionyl chloride were distilled off under a reduced pressure to produce the desired acid chloride.

2. Synthesis of Coupler C-(1)

9.4 g of 2-amino-4-chloro-5-methylphenol was dissolved in 120 ml of acetonitrile, and the acid chloride obtained in the first step described above was added dropwise thereto with refluxing. After the completion of the addition, the mixture was stirred for 3 hours with refluxing. After cooling, ethyl acetate was added to the mixture and water wash was repeated three times. A residue obtained by distilling off the solvent under a reduced pressure was recrystallized with a mixture of ethyl acetate and hexane to obtain 24 g of crystals having a melting point of 124° to 125° C.

Elementary analysis: Calculated: C: 61.34%; H: 7.33%; N: 5.50%. Found: C: 61.00%, H: 7.46%; N: 5.50%.

Synthesis of
4-chloro-5-[2-(2,4-di-tert-amylphenoxy)butanamido]-2-(2-methanesulfonamidobenzoylamino)phenol: Coupler C-(8)

1. Synthesis of 2-methanesulfonamidobenzoyl chloride 30.2 g of methyl anthranilate was dissolved in a mixture of 50 ml of acetonitrile and 25 ml of pyridine, and 20 ml of methanesulfonyl chloride was added dropwise thereto. After stirring at room temperature for 2 hours, the mixture was poured into an aqueous mixture of excess hydrochloric acid and ice to form crystals. The resulting crystals were collected by filtration, washed with water and dissolved in 100 ml of ethanol. After adding to the solution a solution obtained by dissolving 20 g of sodium hydroxide in 100 ml of water, the mixture was stirred at 60° C. for 4 hours. Crystals deposited by acidifying with hydrochloric acid were collected by filtration and washed with water. After drying, 39 g of crystals were obtained. To the crystals, 16 ml of benzene was added and 26 ml of thionyl chloride was then added dropwise. After heating for 6 hours under refluxing, the solvent and excess thionyl chloride were removed under a reduced pressure to obtain the desired acid chloride.

2. Synthesis of Coupler C-(8)

28 g of 2-amino-4-chloro-5-nitrophenol was dissolved in 100 ml of acetonitrile and the acid chloride obtained in the above step was added dropwise thereto with refluxing. After the completion of addition, the mixture was stirred for 4 hours with refluxing. After cooling, the deposited crystals were collected by filtration to obtain 32 g of the crystals. These crystals were dissolved in 250 ml of isopropanol, and subjected to hydrogenation in an autoclave using a vanadium-carbon catalyst (at 50° C., and an initial hydrogen pressure of 50 kg/cm$^2$). After removing the catalyst by filtration, the solvent was distilled off under a reduced pressure. The residue obtained was dissolved in 200 ml of acetonitrile. 28 g of 2-(2,4-di-tert-amylphenoxy)butanoyl chloride was added dropwise thereto with refluxing. After refluxing for 2 hours, the product was poured into water and extracted with ethyl acetate. After being washed with water, the solvent was distilled off under a reduced pressure and the resulting residue was recrystallized with a mixture of acetonitrile and methanol to obtain 40 g of crystals having a melting point of 199° to 201° C.

Elementary analysis: Calculated: C: 62.04%; H: 6.74%; N: 6.39%. Found: C: 62.10%; H: 6.78%; N: 6.24%.

The magenta coupler represented by the general formula (I) can be synthesized by the processes as described in Japanese Patent Application (OPI) No. 9828/76.

The photographic emulsion layer or layers in the photographic light-sensitive material produced utilizing the couplers of the present invention may contain a color image forming coupler, i.e., a compound capable of forming a dye upon the reaction with the oxidation product of an aromatic amine (usually primary amine) developing agent (hereinafter referred to as a coupler), other than the couplers of the present invention. It is preferred that these other couplers be nondiffusible ones having a hydrophobic group called a ballast group in the molecule. Also, the other couplers may have either a 4-equivalent or a 2-equivalent property with respect to the silver ion. Furthermore, the layers may contain a colored coupler having a color correction effect or a coupler which releases a development inhibitor (the so-called DIR coupler) upon development. The other couplers may also be those which form a colorless product by the coupling reaction.

As yellow color forming couplers, known open chain ketomethylene type couplers can be used. Among them, benzoylacetanilide type compounds and pivaloylacetanilide type compounds are advantageously used. Examples of the yellow color forming couplers capable of being used include those described in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76 and Japanese Patent Application (OPI) Nos. 26133/72, 73147/73, 102636/76, 6341/75, 130442/75, 21827/76, 87650/75, 82424/77 and 115219/77.

As magenta color forming couplers, pyrazolone type compounds, imidazolone type compounds and cyanoacetyl type compounds can be used, and pyrazolone type compounds are particularly advantageous to use. Examples of the magenta color forming couplers include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959 and 2,424,467, Japanese Patent Publication No. 6031/65 and Japanese Patent Application (OPI) Nos. 20826/76, 58922/77, 129538/74, 74027/74, 159336/75, 42121/77, 74028/74, 60233/75, 26541/76 and 55122/78.

As cyan color forming couplers, phenol type compounds and naphthol type compounds can be used. Specific examples of them include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329 and Japanese Patent Application (OPI)

Nos. 59838/73, 26034/76, 5055/73, 146828/76, 69624/77 and 90932/77.

As colored couplers, it is possible to use those described, for example, in U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77 and West German Patent Application (OLS) No. 2,418,959.

As DIR couplers, it is possible to use those described, for example, in U.S. Pat. Nos. 3,227,554, 3,617,291, 3,701,783, 3,790,384 and 3,632,345, West German Patent Application (OLS) Nos. 2,414,006, 2,454,301 and 2,454,329, British Pat. No. 953,454, Japanese Patent Application (OPI) Nos. 69624/77 and 122335/74 and Japanese Patent Publication No. 16141/76.

The light-sensitive material may contain compounds capable of releasing a development inhibitor upon development other than the DIR couplers. For example, it is possible to use those described in U.S. Pat. Nos. 3,297,445 and 3,379,529, West German Patent Application (OLS) No. 2,417,914 and Japanese Patent Application (OPI) Nos. 15271/77 and 9116/78.

Two or more of the above described couplers may be contained in the same layer. The same compound may be contained in two or more layers.

Both the couplers of the present invention and the above described couplers are incorporated in the silver halide emulsion layers by known methods, for example, by a method as described in U.S. Pat. No. 2,322,027. For example, they can be dispersed in a hydrophilic colloid after being dissolved in phthalic acid alkyl esters (dibutyl phthalate or dioctyl phthalate, etc.), phosphoric acid esters (diphenyl phosphate, triphenyl phosphate, tricresyl phosphate or dioctylbutyl phosphate), citric acid esters (for example, tributyl acetylcitrate), benzoic acid esters (for example, octyl benzoate), alkylamides (for example, diethyl laurylamide) or aliphatic acid esters (for example, dibutoxyethyl succinate or dioctyl azelate), etc. or organic solvents having a boiling point of from about 30° C. to 150° C. Examples include a lower alkyl acetate such as ethyl acetate or butyl acetate, ethyl propionate, secondary butyl alcohol, methyl isobutyl ketone, $\beta$-ethoxyethyl acetate or methyl cellosolve acetate, etc. The above described high boiling point organic solvents and low boiling point organic solvents may be used as a mixture thereof.

Furthermore, it is possible to use a method of dispersion using polymers, as described in Japanese Patent Publication No. 39853/76 and Japanese Patent Application (OPI) No. 59943/76.

If the couplers have acid groups such as a carboxylic acid group or a sulfonic acid group, they are incorporated in the hydrophilic colloid in the form of an alkaline aqueous solution.

In the light-sensitive materials produced by the present invention, the hydrophilic colloid layers may contain an ultraviolet ray absorbing agent. For example, it is possible to use benzotriazole compounds substituted by aryl groups (for example, those described in U.S. Pat. No. 3,533,794), 4-thiazolidone compounds (for example, those described in U.S. Pat. Nos. 3,314,794 and 3,352,681), benzophenone compounds (for example, those described in Japanese Patent Application (OPI) No. 2784/71), cinnamic acid ester compounds (for example, those described in U.S. Pat. Nos. 3,705,805 and 3,707,375), butadiene compounds (for example, those described in U.S. Pat. No. 4,045,229) and benzoxazole compounds (for example, those described in U.S. Pat. No. 3,700,455). Further, it is possible to use those described in U.S. Pat. No. 3,499,762 and Japanese Patent Application No. 48535/79. Ultraviolet ray absorbing couplers (for example, $\alpha$-naphthol type cyan dye forming couplers) or ultraviolet ray absorbing polymers may be used, too. These ultraviolet ray absorbing agents may be mordanted in a specified layer.

As a binder or a protective colloid in the photographic light-sensitive material of the present invention, gelatin is advantageously used, but hydrophilic colloids other than gelatin can also be used. For example, it is possible to use proteins such as gelatin derivatives, graft polymers of gelatin with another high molecular substance, albumin, casein, etc.; saccharides such as cellulose derivatives such as hydroxyethyl cellulose, carboxymethyl cellulose or cellulose sulfate, etc., sodium alginate, starch derivatives, etc.; and various synthetic hydrophilic high molecular materials such as homopolymers or copolymers including polyvinyl alcohol, polyvinyl alcohol semiacetal, poly-N-vinylpyrrolidone, polyacrylic acid, polymethacrylic acid, polyacrylamide, polyvinylimidazole and polyvinylpyrazole, etc.

As the gelatin, not only lime-processed gelatin, but also acid-processed gelatin and enzyme-processed gelatin, as described in *Bull. Soc. Sci. Phot. Japan,* No. 16, page 30 (1966), may be used. Further, hydrolysis products and enzymatic decomposition products of gelatin can be used, too. As gelatin derivatives, it is possible to use those which are obtained by reacting gelatin with various compounds, for example, acid halides, acid anhydrides, isocyanates, bromoacetic acid, alkane sultones, vinyl sulfonamides, maleinimide compounds, polyalkylene oxides and epoxy compounds, etc. Examples of them have been described in U.S. Pat. Nos. 2,614,928, 3,132,945, 3,186,846 and 3,312,553, British Pat. Nos. 861,414, 1,033,189 and 1,005,784 and Japanese Patent Publication No. 26845/67, etc.

As the graft polymers of gelatin, it is possible to use those obtained by grafting gelatin with homo- or copolymers of vinyl monomers such as acrylic acid, methacrylic acid and derivatives thereof such as esters or amides, etc., acrylonitrile or styrene, etc. Particularly, it is preferred to use graft polymers of gelatin with polymers having some degree of compatibility with gelatin, for example, polymers of acrylic acid, methacrylic acid, acrylamide, methacrylamide or hydroxyalkyl methacrylate, etc. Examples thereof have been described in U.S. Pat. Nos. 2,763,625, 2,831,767 and 2,956,884.

Typical examples of the synthetic high molecular materials are those described in West German Patent Application (OLS) No. 2,312,708, U.S. Pat. Nos.3,620,751 and 3,879,205 and Japanese Patent Publication No. 7561/68.

For the purpose of preventing fogging in the step of producing light-sensitive materials, during preservation or during photographic processing or to stabilize photographic properties, it is possible to add various compounds to the photographic emulsions used in the present invention. Namely, it is possible to add many compounds known as antifogging agents or stabilizing agents such as azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimdazoles, mercaptothiadiazoles, aminotriazoles, benzotriazoles, nitrobenzotriazole and mercaptotetrazoles (particularly, 1-phenyl-5-mercaptotetrazole), etc.; mercaptopyrimidines; mercaptotriazines; thioketo compounds such as oxazoline thione; azaindenes, for example, triazaindenes, tetrazaindenes (particularly, 4-hydroxy substituted-1,3,3a,7)-tetrazaindenes) and pentazaindenes, etc.; benzenethiosulfonic acids, benzenesulfinic acids and benzenesulfonic acid amides, etc. For example, it is possible to use compounds as described in U.S. Pat. Nos. 3,954,474 and 3,982,947 and Japanese Patent Publication No. 28660/77.

For the purpose of increasing sensitivity, increasing contrast, or accelerating development, the photographic emulsion layers of the photographic light-sensitive materials of the present invention may contain, for example, polyalkylene oxide or derivatives thereof such as ethers, esters or amines, etc., thio ether compounds, thiomorpholinic acid, quaternary ammonium salts, urethane derivatives, urea derivatives, imidazole derivatives and 3-pyrazolidones, etc. For example, it is possible to use compounds as described in U.S. Pat. Nos. 2,400,532, 2,423,549, 2,716,062, 3,617,280, 3,772,021 and 3,808,003 and British Pat. No. 1,488,991, etc., for this purpose also.

The photographic emulsions used in the present invention may be spectrally sensitized with methine dyes or others. The dyes used include cyanine dyes, merocyanine dyes, complex cyanine dyes, complex merocyanine dyes, holopolar cyanine dyes, hemicyanine dyes, styryl dyes and hemioxonol dyes. Particularly suitable dyes are dyes belonging to cyanine dyes, merocyanine dyes and complex merocyanine dyes. These dyes may have as a basic heterocyclic nucleus any nuclei utilized generally for cyanine dyes. Namely, it is possible to utilize a pyrroline nucleus, as oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus, etc.; nuclei wherein an alicyclic hydrocarbon ring is condensed with the above described nuclei; and nuclei wherein an aromatic hydro-carbon ring is condensed with the above described nuclei, for example, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and quinoline nucleus, etc. These nuclei may have substituents on the carbon atoms.

In the merocyanine dyes and the complex merocyanine dyes, it is possible to utilize as a nucleus having ketomethylene structure, a 5- or 6-membered heterocyclic nucleus such as a pyrazolin-5-one nucleus, a thiohydantoin nucleus, a 2-thioxazolidine-2,4-dione nucleus, a thiazolidine-2,4-dione nucleus, a rhodanin nucleus or a thiobarbituric acid nucleus, etc.

Examples of useful sensitizing dyes are those described in West German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588 and Japanese Patent Publication Nos. 14030/69 and 24844/77.

These sensitizing dyes can be used alone, or they may be used as a combination thereof. The combinations of the sensitizing dyes are often used for, particularly, the purpose of supersensitization. Typical examples of them have been described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 4936/68 and 12375/78 and Japanese Patent Application (OPI) Nos. 110618/77 and 109925/77.

The emulsions may contain dyes which do not have a spectral sensitization function themselves or substances which do not substantially absorb visible rays, but show a supersensitization function, together with the sensitizing dyes. For example, they may contain aminostilbene compounds substituted with a nitrogen containing heterocyclic group (for example, U.S. Pat. Nos. 2,933,390 and 3,635,721), aromatic organic acid-formaldehyde condensates (for example, U.S. Pat. No. 3,743,510), cadmium salts or azaindene compounds, etc. Combinations described in U.S. Pat. Nos. 3,615,613, 3,615,641, 3,617,295 and 3,635,721 are particularly preferred.

In the light-sensitive materials produced utilizing the present invention, the hydrophilic colloid layers may contain water soluble dyes as filter dyes or for the purpose of preventing irradiation or others. Such dyes include oxonol dyes, hemioxonol dyes, styryl dyes, merocyanine dyes, cyanine dyes and azo dyes. Particularly, oxonol dyes, hemioxonol dyes and merocyanine dyes are preferred. Examples of such dyes capable of being used include those described in British Pat. Nos. 584,609 and 1,177,429, Japanese Patent Application (OPI) Nos. 85130/73, 99620/74, 114420/74 and 108115/77 and U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

In the light-sensitive materials produced utilizing the present invention, photographic emulsion layers and other hydrophilic colloid layers may contain whitening agents such as stilbene, triazine, oxazole or coumarin type whitening agents. These whitening agents may be soluble in water. In the case of water insoluble whitening agents, they may be used as a dispersion. Examples of fluorescent whitening agents have been described in U.S. Pat. Nos. 2,632,701, 3,269,840 and 3,359,102 and British Pat. Nos. 852,075 and 1,319,763, etc.

When the present invention is carried out, known antifading agents may be used therewith. Furthermore, the color image stabilizers may be used in the light-sensitive materials according to the present invention, alone or as a mixture of two or more of them. The antifading agents include, for example, hydroquinone derivatives as described in U.S. Pat. Nos. 2,360,290, 2,418,613, 2,675,314, 2,701,197, 2,704,713, 2,728,659, 2,732,300, 2,735,765, 2,710,801 and 2,816,028 and British Pat. Nos. 1,363,921, etc., gallic acid derivatives as described in U.S. Pat. Nos. 3,457,079 and 3,069,262, etc., p-alkoxyphenols as described in U.S. Pat. Nos. 2,735,765 and 3,698,909 and Japanese Patent Publication Nos. 20977/74 and 6623/77, p-oxyphenol derivatives as described in U.S. Pat. Nos. 3,432,300, 3,573,050, 3,574,627 and 3,764,337 and Japanese Patent Application (OPI) Nos. 35633/77, 147343/77 and 152225/77, and bisphenols as described in U.S. Pat. No. 3,700,455.

The light-sensitive materials according to the present invention may contain hydroquinone derivatives, aminophenol derivatives, gallic acid derivatives or ascorbic acid derivatives as anti-color-fogging agents. Examples thereof are described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77 and Japanese Patent Publication No. 23813/75, etc.

The present invention can be applied to multilayer multicolor photographic materials comprising layers of at least two different spectral sensitivities on a base. The multilayer technicolor photographic materials generally have at least a red-sensitive emulsion layer, a green-sensitive emulsion layer, and a blue-sensitive emulsion layer on a base. The order of these layers can be suitably selected as occasion demands. Generally, the red-sensitive emulsion layer contains a cyan forming coupler, the green-sensitive emulsion layer contains a magenta forming coupler, and the blue-sensitive emulsion contains a yellow forming coupler, but other combinations can be adopted if desired.

Photographic processing of the light-sensitive materials of the present invention can be carried out by known processes. Known processing solutions can be used. The processing temperature is generally selected from the range from 18° C. to 50° C., but a temperature lower than 18° C. or a temperature higher than 50° C. may be used. Known development processes for forming silver images (black-white photographic processing) and development processing for forming dye images may be adopted as the color photographic processing, according to the particular purpose.

The color developing solution generally consists of an alkaline aqueous solution containing a color developing agent. As the color developing agent, it is possible to use known primary aromatic amine developing agents, for example, phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline and 4-amino-3-methyl-N-ethyl-N-β-methoxyethylaniline, etc.).

In addition, compounds described in *Photographic Processing Chemistry,* pages 226 to 229, by L. F. A. Mason (published by Focal Press, 1966), U.S. Pat. Nos. 2,193,015 and 2,592,364 and Japanese Patent Application (OPI) No. 64933/73, etc. may be used.

The color developing solution is capable of containing pH buffers such as sulfites, carbonates, borates or phosphates of alkali metals, and development restrainers or antifogging agents such as bromides, iodides or organic antifogging agents. Furthermore, if desired, the solution may contain water softeners, preservatives such as hydroxylamine, organic solvents such as benzyl alcohol or diethylene glycol, development accelerators such as polyethylene glycol, quaternary ammonium salts or amines, dye forming couplers, competition couplers, fogging agents such as sodium borohydride, auxiliary developing agents such as 1-phenyl-3-pyrazolidone, polycarboxylic acid chelating agents as described in U.S. Pat. No. 4,083,723 and antioxidants as described in West German Patent Application (OLS) No. 2,622,950, etc.

The photographic emulsion layers after color development are generally subjected to bleaching. The bleaching may be carried out simultaneously with fixing or may be carried out respectively. As bleaching agents, compounds of polyvalent metals such as iron (III), cobalt (IV), chromium (VI) or copper (II), etc., peracids, quinones and nitroso compounds are used. For example, it is possible to use ferricyanides, bichromates, organic complex salts of iron (III) or cobalt (III) and complex salts of aminopolycarboxylic acids such as ethylenediaminetetraacetic acid, nitrilotriacetic acid or 1,3-diamino-2-propanol tetraacetic acid, etc. or organic acids such as citric acid, tartaric acid or malic acid, etc.; persulfates and permanganates; and nitrosophenol, etc. Among them, potassium ferricyanide, sodium (ethylenediaminetetraacetato) iron (III) complex and ammonium (ethylenediaminetetraacetato) iron (III) complex are particularly useful. (Ethylenediaminetetraacetato) iron (III) complex salts are useful for both a bleaching solution or a one-bath bleach-fixing solution.

To the bleaching solution or the bleach-fixing solution, it is possible to add various additives in addition to bleaching accelerators as described in U.S. Pat. Nos. 3,042,520 and 3,241,966 and Japanese Patent Publication Nos. 8506/70 and 8836/70, etc. and thiol compounds described in Japanese Patent application (OPI) No. 65732/78.

In the following, the present invention is explained in detail with reference to the examples, but the present invention is not to be construed as being limited thereto.

EXAMPLE 1

Onto a paper sheet whose surface was covered with polyethylene were coated, as a first layer, a blue-sensitive silver chlorobromide emulsion (20 mol% chloride) containing α-pivaloyl-α-(5,5-dimethyl-3-hydantoinyl)-2-chloro-5-[α-(2,4-di-tert-amylphenoxy)-butyramido]acetanilide in a thickness of 3.0 microns, and thereon gelatin (using a 2% gelatin aqueous solution) in a thickness of 1.5 microns as a second layer.

A solution obtained by dissolving 4 g of Coupler M-11 according to the present invention, 0.3 g of 2,5-di-tert-octylhydroquinone, 0.4 g of 6,6'-dihydroxy-7,7'-dimethoxy-4,4,4',4'-tetramethylbis-2,2'-spirochroman, 4.0 ml of tricresyl phosphate and 12 ml of ethyl acetate with heating at 60° C. was added to 40 ml of an aqueous solution containing 4 g of gelatin and 0.10 g of sodium dodecylbenzenesulfonate at 60° C. The solution mixture was stirred with a homogenizer to prepare a coupler dispersion. The coupler dispersion was mixed with 100 g of a green-sensitive photographic emulsion containing 8.8 g of silver chlorobromide (30 mol% chloride) and 9 g of gelatin and 8 ml of a 2% aqueous solution of 4,6-dichloro-2-hydroxytriazine was added thereto as a hardening agent. After adjusting the pH to 7.0, the mixture was coated on the above described second layer as a third layer in a thickness of 3.4 microns. Then gelatin containing 2-(5-chlorobenzotriazol-2-yl)-4-methyl-6-tert-butylphenol and 2-(benzotriazol-2-yl)-4-tert-butylphenol was coated in a thickness of 1.5 microns as a fourth layer.

A solution obtained by dissolving 2.5 g of Coupler C-(1) according to the present invention, 3.5 ml of trioctyl phosphate and 5 ml of ethyl acetate with heating at 60° C. was added to 25 ml of an aqueous solution containing 2.5 g of gelatin and 0.1 g of sodium dodecylbenzene sulfonate at 60° C. The solution mixture was stirred with a homogenizer to prepare a coupler dispersion. The coupler dispersion was mixed with 100 g of a red-sensitive photographic emulsion containing 5.4 g of silver chlorobromide (50 mol% chloride) and 6 g of gelatin and 8 ml of a 2% aqueous solution of 4.6-dichloro-2-hydroxytriazine was added thereto as a hardening agent. After adjusting the pH to 6.0, the mixture was coated on the above described fourth layer as a fifth layer in a thickness of 2.5 microns, and finally, as an uppermost layer, gelatin was coated in a thickness of 1 micron to prepare a color photographic light-sensitive material. This is designated Sample (A).

Color photographic materials were prepared in the same manner as Sample (A) except that an equimolar amount of Coupler C-(10) or Coupler C-(20) was used in place of Cyan Coupler C-(1) described above. These are designated Samples (B) and (C), respectively.

Further, for comparison, color photographic materials were prepared in the same manner as Sample (A) except that an equimolar amount of Comparison Coupler C-(101), Comparison Coupler C-(102) or Comparison Coupler C-(103) were used in place of Cyan Coupler C-(1) described above. These are designated Samples (D), (E) and (F), respectively.

Comparison Coupler C-(101)

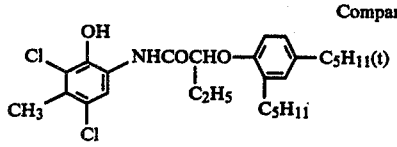

Comparison Coupler C-(102)

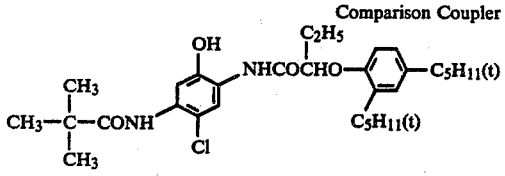

Comparison Coupler C-(103)

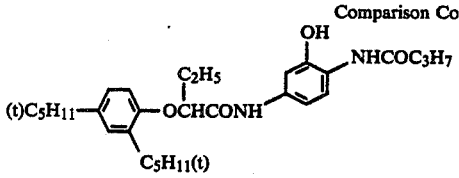

Furthermore, each of the first layer and five kinds of the fifth layer described above were coated on a support same as used in the above samples and then gelatin was coated thereon in a thickness of 1 micron to prepare Samples (G), (H), (I), (J), (K), (L) and (M), respectively.

These samples were stepwise exposed to green light and subjected to the following development processing.

| Processing Step | Temp. | Time |
|---|---|---|
| 1. Color Development | 30° C. | 4 min. |
| 2. Bleach Fixing | " | 2 min. |
| 3. Water Washing | " | 2 min. |
| 4. Stabilizing | " | 2 min. |

The composition of each processing solution for the development processing was as follows.

| Composition of Color Developer | |
|---|---|
| Sodium Metaborate | 25 g |
| Sodium Sulfite | 2 g |
| Hydroxylamine (sulfate) | 2 g |
| Potassium Bromide | 0.5 g |
| 6-Nitrobenzimidazole (nitrate) | 0.02 g |
| Sodium Hydroxide | 4 g |
| Benzyl Alcohol | 15.8 ml |
| Diethylene Glycol | 20 ml |
| 4-(N—Ethyl-N—methanesulfonamidoethyl)-amino-2-methylaniline Sesquisulfate | 8 g |
| Water to make | 1 l |
| **Composition of Bleach Fixing Solution** | |
| Ferric Salt of Ethylenediamine-Tetraacetate | 45 g |
| Ammonium Thiocyanate | 10 g |
| Sodium Sulfite | 10 g |
| Ammonium Thiosulfate (60% aq. soln.) | 100 ml |
| Tetrasodium Ethylenediamine Tetraacetate | 5 g |
| Water to make | 1 l |

-continued

| Composition of Stabilizing Bath | |
|---|---|
| Tartaric Acid | 10 g |
| Zinc Sulfate | 10 g |
| Sodium Metaborate | 20 g |
| Water to make | 1 l |

With respect to the samples obtained, the yellow stain density at the unexposed area was determined by measuring the reflection density thereof with a densitometer equipped with a blue filter, respectively. Thereafter, these samples were stored for 3 days, 6 days or 9 days in a xenon tester (about 10,000 lux) and the increase in the yellow stain density was measured. The results obtained are shown in Table 1 below.

TABLE 1

| Sample No. | Coupler Used | Increase in Yellow Stain Density at Unexposed Area After 3 Days | After 6 Days | After 9 Days |
|---|---|---|---|---|
| (A) | Coupler C-(1) (Present Invention) | +0.06 | +0.08 | +0.10 |
| (B) | Coupler C-(10) (Present Invention) | +0.05 | +0.07 | +0.09 |
| (C) | Coupler C-(20) (Present Invention) | +0.06 | +0.08 | +0.09 |
| (D) | Comparison Coupler C-(101) | +0.07 | +0.11 | +0.16 |
| (E) | Comparison Coupler C-(102) | +0.06 | +0.12 | +0.17 |
| (F) | Comparison Coupler C-(102) | +0.08 | +0.11 | +0.16 |
| (G) | Yellow Coupler | +0.02 | +0.005 | +0.005 |
| (H) | Coupler C-(1) (Present Invention) | ±0.00 | ±0.00 | +0.005 |
| (I) | Coupler C-(10) (Present Invention) | −0.01 | ±0.00 | ±0.00 |
| (J) | Coupler C-(20) (Present Invention) | ±0.00 | −0.01 | +0.005 |
| (K) | Comparison Coupler C-(101) | ±0.00 | +0.01 | +0.02 |
| (L) | Comparison Coupler C-(102) | −0.01 | ±0.00 | +0.01 |
| (M) | Comparison Coupler C-(103) | ±0.00 | −0.01 | ±0.00 |

It is apparent from the results shown in Table 1 above that the yellow stain at the unexposed area due to irradiation with light arises from the magenta coupler and the samples using the cyan couplers according to the present invention provide less increase in yellow stain density.

EXAMPLE 2

In the same manner as described in Example 1, a first layer and a second layer were coated.

A coupler dispersion was obtained in the same manner as described in Example 1 but using 4 g of Coupler M-(12) according to the present invention, 0.3 g of 2,5-di-tert-octylhydroquinone, 0.4 g of 6,6'-dihydroxy-7,7'-dimethoxy-4,4,4',4'-tetramethylbis-2,2'-spirochroman, 4.0 ml of tricresyl phosphate and 12 ml of ethyl acetate. The coupler dispersion was mixed with 50 g of a green-sensitive photographic emulsion containing 4.4 g of silver chlorobromide (30 mol% chloride) and 4.5 g of gelatin and 5 ml of 2% aqueous solution of 4,6-dichloro-2-hydroxytriazine was added thereto as a hardening agent. After adjusting the pH to 7.0, the mixture was coated on the above described second layer in a thickness of 2.5 microns as a third layer. Then, gelatin containing 2-(5-chlorobenzotriazol-2-yl)-4-methyl-6-tert-butylphenol and 2-(benzotriazol-2-yl)-4-tert-butylphenol was coated on the above described third layer in a thickness of 1.5 microns as a fourth layer. A red-sensitive emulsion layer containing Coupler C-(1) was coated on the above described fourth layer in a thickness of 2.5 microns as a fifth layer in the same manner as described in Example 1, and finally, as an uppermost layer, gelatin was coated in a thickness of 1 micron to prepare a color photographic light-sensitive material. This is designated Sample (N).

Color photographic materials were prepared in the same manner as Sample (N) except that equimolar amounts of Coupler C-(10) or Coupler C-(20) were used in place of Cyan Coupler C-(1) described above. These samples are designated Samples (O) and (P), respectively.

Further, for comparison, color photographic materials were prepared in the same manner as Sample (N) except that an equimolar amounts of Comparison Coupler C-(101), Comparison coupler C-(102) or Comparison Coupler C-(103) were used in place of Cyan Coupler C-(1) described above. These samples are designated Samples (Q), (R) and (S), respectively.

These samples were subjected to the same development processing described in Example 1. With respect to the samples obtained, the increase in the yellow stain density at the unexposed area was measured in the same manner as described in Example 1. The results obtained are shown in Table 2 below.

TABLE 2

| Sample No. | Coupler Used | Increase in Yellow Stain Density at Unexposed Area After 3 Days | After 6 Days | After 9 Days |
|---|---|---|---|---|
| (N) | Coupler C-(1) (Present Invention) | +0.08 | +0.11 | +0.13 |
| (O) | Coupler C-(10) (Present Invention) | +0.07 | +0.09 | +0.12 |
| (P) | Coupler C-(20) (Present Invention) | +0.07 | +0.10 | +0.12 |
| (Q) | Comparison Coupler C-(101) | +0.08 | +0.15 | +0.23 |
| (R) | Comparison Coupler C-(102) | +0.08 | +0.17 | +0.25 |
| (S) | Comparison Coupler C-(103) | +0.09 | +0.16 | +0.23 |

It is apparent from the results shown in Table 2 above that the samples using the cyan couplers according to the present invention provide less increase in yellow stain density at the unexposed area upon irradiation with light.

While the invention has been described in detail and with reference to specific embodiment thereof, it will be apparent to one skilled in the art that various changes and modifications can be made therein without departing from the spirit and scope thereof.

What is claimed is:

1. A color photographic light-sensitive material comprising: a support; and positioned on the support a green-sensitive silver halide emulsion layer containing a magenta dye forming coupler represented by the following general formula (I)

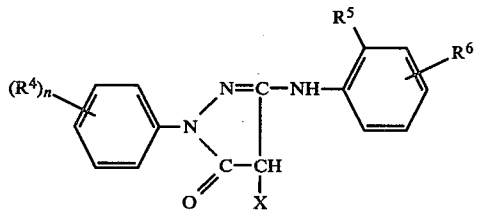

(I)

wherein $R^4$ represents a halogen atom, a substituted or unsubstituted alkyl group or a substituted or unsubstituted alkoxy group; $R^5$ represents a hydrogen atom, a halogen atom, a nitro group, a substituted or unsubstituted alkyl group, a substituted or unsubstituted alkoxy group or a substituted or unsubstituted acylamino group; $R^6$ represents a hydrogen atom, a halogen atom or a mono-valent organic residue; X represents a hydrogen atom or a group capable of being released upon coupling and exhibiting a two-equivalent property; and n represents an integer from 1 to 5 and when n represents 2 or more, $R^4$ may be the same or different, and a red-sensitive silver halide emulsion layer containing a cyan dye forming coupler represented by the following general formula (II)

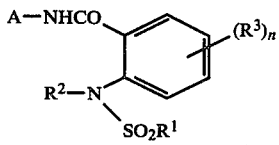

(II)

wherein A represents a cyan coupler residue, but the —NHCO group does not bond to A in the active position of A; $R^1$ represents a substituted or unsubstituted alkyl group or a substituted or unsubstituted aryl group, $R^2$ represents hydrogen or a substituted or unsubstituted alkyl group; each $R^3$ independently represents a hydrogen atom, a halogen atom, an alkyl group or an alkoxy group; and n represents an integer from 1 to 3 and when n represents 2 or more.

2. A color photographic light-sensitive material as in claim 1, wherein the mono-valent organic residue represented by $R^6$ is a nitro group, a carbamoyl group having up to 22 carbon atoms which may be substituted, a sulfamoyl group having up to 22 carbon atoms which may be substituted, an alkyl succinimido group having up to 22 carbon atoms which may be substituted, an alkoxycarboamido group having up to 22 carbon atoms which may be substituted, an alkoxycarboalkylamino group having up to 22 carbon atoms which may be substituted, an alkylaminocarboalkylamino group having up to 22 carbon atoms which may be substituted, an aralkoxycarboalkylamino group having up to 22 carbon atoms which may be substituted, an arylaminocarboalkylamino group having up to 22 carbon atoms which may be substituted or an aralkylaminocarboalkylamino group.

3. A color photographic light-sensitive material as in claim 1, wherein the group capable of being released upon coupling is an alkylthio group which may be substituted, an arylthio group which may be substituted, an aralkylthio group which may be substituted, a pyrazolyl group which may be substituted, an imidazolyl group which may be substituted, or a thiazolyl group which may be substituted.

4. A color photographic light-sensitive material as in claim 1, wherein $R^4$ represents a halogen atom or an alkoxy group having 1 to 15 carbon atoms.

5. A color photographic light-sensitive material as in claim 1, wherein $R^4$ is a halogen atom, $R^5$ is a halogen atom and X is an alkylthio group, an arylthio group or an aralkylthio group.

6. A color photographic light-sensitive material as in claim 1, wherein $R^1$ represents a substituted or unsubstituted alkyl group having from 1 to 22 carbon atoms or a substituted or unsubstituted aryl group having from 6 to 22 carbon atoms; $R^2$ represents hydrogen or a substituted or unsubstituted alkyl group having from 1 to 22 carbon atoms; each $R^3$ independently represents a hydrogen atom, a halogen atom, an alkyl group having from 1 to 22 carbon atoms or an alkoxy group having from 1 to 22 carbon atoms; and n represents an integer from 1 to 3 and when n represents 2 or more.

7. A color photographic light-sensitive material as in claim 1, wherein the substituents of the alkyl groups and aryl groups represented by $R^1$ and $R^2$ are selected from a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, an acyloxy group, a sulfamoyl group, a carbamoyl group, an acylamino group, a diacylamino group, a ureido group, an arylamino group, an N-alkylanilino group, an N-acylanilino group, a hydroxy group, and a mercapto group.

8. A color photographic light-sensitive material as in claim 2, wherein $R^1$ is a methyl group, a butyl group, a methoxyethyl group, a dodecyl group, a phenoxypropyl group, a p-chlorophenoxybutyl group, a p-tolyl group, a p-dodecylphenyl group, a p-chlorophenyl group, or a naphthyl group; and $R^2$ is a methyl group, a butyl group, an octyl group, a hexadecyl group, a 2-chloroethyl group, or a 2-methoxyethyl group.

9. A color photographic light-sensitive material as in claim 1, wherein A represents a phenol cyan coupler residue represented by the following general formula (III)

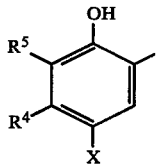

(III)

wherein $R^4$ represents a substituted or unsubstituted alkyl group, a substituted or unsubstituted alkylacylamino group, or a substituted or unsubstituted arylacylamino group; $R^5$ represents a hydrogen atom or a halogen atom; and X represents a hydrogen atom or a group capable of being released by an oxidation coupling reaction with a developing agent.

10. A color photographic light-sensitive material as in claim 9, wherein the substituents of $R^4$ are selected from a halogen atom, a nitro group, a cyano group, aryl group, an alkoxy group, an aryloxy group, a carboxy group, an alkylcarbonyl group, an arylcarbonyl group, an alkoxycarbonyl group, an aryloxycarbonyl group, an acyloxy group, a sulfamoyl group, a carbamoyl group, an acylamino group, a diacylamino group, a ureido group, an arylamino group, an N-alkylanilino group, an N-acylanilino group, a hydroxy group, and a mercapto group.

11. A color photographic light-sensitive material as in claim 9, wherein $R^4$ is an alkyl group selected from a methyl group, an ethyl group, a butyl group, a pentadecyl group, a phenylthiomethyl group, and a chloromethyl group, or an alkylacylamino group selected from a butyrylamino group, a pivaloylamino group and a 2-(2',4'-di-tert-amylphenoxy)butanamido group; and the arylacylamino group of $R^4$ represents a benzoylamino group.

12. A color photographic light-sensitive material as in claim 9, wherein the group capable of being released by an oxidation coupling reaction with a developing agent is a halogen atom, an alkoxy group, an aryloxy group, an acyloxy group, an imido group, a sulfonamido group or a thiocyano group.

13. A color photographic light-sensitive material as in claim 9, wherein $R^4$ is a substituted or unsubstituted alkylacylamino group.

14. A color photographic light-sensitive material as in claim 9, wherein $R^5$ is a hydrogen atom.

15. A color photographic light-sensitive material as in claim 1, wherein an amount of the magenta dye forming coupler represented by the general formula (I) is from $2\times10^{-3}$ mol to $5\times10^{-1}$ mol per mol of silver in the red-sensitive silver halide emulsion layer.

16. A color photographic light-sensitive material as in claim 9, wherein the amount of the cyan dye forming coupler is 1/10 of the amount of the magenta dye forming coupler or more.

17. A color photographic light-sensitive material as in claim 1, wherein the color photographic material further comprising a blue-sensitive silver halide emulsion layer.

18. A color photographic light-sensitive material as in claim 17, wherein the blue-sensitive silver halide emulsion layer contains a yellow dye forming coupler.

19. A color photographic light-sensitive material as in claim 18, wherein the yellow dye forming coupler, the magenta dye forming coupler and the cyan dye forming coupler are non-diffusible.

* * * * *